US006138697A

United States Patent [19]

Hörger et al.

[11] Patent Number: 6,138,697

[45] Date of Patent: Oct. 31, 2000

[54] HYDRODYNAMIC APPARATUS FOR CLEANING CHANNELS AND FOR MONITORING CHANNELS

[76] Inventors: Kurt Hörger, Kleiststrasse 13, 09130 Cheminitz; Hans Lutze, Am Karbel 25, 09116 Chemnitz, both of Germany

[21] Appl. No.: 08/810,539

[22] Filed: Mar. 3, 1997

[30] Foreign Application Priority Data

Mar. 1, 1996 [DE] Germany ..... 196 07 913

[51] Int. Cl.[7] ..... B08B 9/02

[52] U.S. Cl. ..... 134/167 C; 134/168 C

[58] Field of Search ..... 134/167 C, 168 C, 134/113, 58 R; 239/13; 15/104.12, 104.31; 358/100; 178/DIG. 1; 354/64; 318/283

[56] References Cited

U.S. PATENT DOCUMENTS

| | | | |
|---|---|---|---|
| 3,715,484 | 2/1973 | Latall | 176/6.8 |
| 4,107,738 | 8/1978 | van Norman | 358/100 |
| 4,756,324 | 7/1988 | Larsson | 134/167 C |
| 5,203,646 | 4/1993 | Landsberger | 405/191 |
| 5,374,970 | 12/1994 | Satoh | 354/64 |
| 5,435,854 | 7/1995 | Derlein | 134/22.11 |
| 5,545,956 | 8/1996 | Salvio | 318/283 |

FOREIGN PATENT DOCUMENTS

| | | |
|---|---|---|
| 0395628 | 10/1990 | European Pat. Off. . |
| 0560611 | 9/1993 | European Pat. Off. . |
| 3111814 | 10/1982 | Germany . |
| 3237583 | 4/1984 | Germany . |
| 9214268 | 4/1993 | Germany . |
| 9308910 | 1/1994 | Germany . |
| 850295 | 12/1985 | WIPO . |

*Primary Examiner*—Frankie L. Stinson
*Assistant Examiner*—Mialeeka C. W. Bibbs
*Attorney, Agent, or Firm*—Horst M. Kasper

[57] ABSTRACT

A hydrodynamic apparatus for cleaning channels and for monitoring channels is provided for pipes and channels. A disadvantage of all conventional bottom floor cleaners, flushing heads, and channel-cleaning nozzles is that during the cleaning process no observation and determination of the soiling state or, respectively, of the cleaning state of the channel and no recognition of damaged areas in the channel is possible. According to the invention, a monitoring unit (6) is installed selectively in or at the channel-cleaning apparatus. For this purpose, for example, a hollow space (11) is furnished at the bottom floor cleaner (S), wherein the monitoring unit (6) is partly integrated into the hollow space (11). The monitoring unit (6) exhibits a camera module (7) or two camera modules (7*a* and 7*b*). A video emitter (15) is coordinated to each camera module (7). The transmission to a video receiver (V) is performed without cable wireless from the video emitter (15). The cleaning process can be followed in a monitor (M). As desired, also ballast material (12) can be filled into the hollow space (11).

23 Claims, 6 Drawing Sheets

HYDRODYNAMIC APPARATUS FOR CLEANING CHANNELS AND FOR MONITORING CHANNELS

BACKGROUND OF THE INVENTION

1. Field of the Invention

The invention relates to a cleaning apparatus and monitoring apparatus for hydrodynamic waterways and channels.

2. Brief Description of the Background of the Invention Including Prior Art

There are already numerous hydrodynamic apparatus for cleaning channels and for monitoring channels furnished as flow-through parts. Such hydrodynamic apparatus exhibits a water connector as a pressurized water-entrance opening, and recoil openings, directed rearwardly and connected to the pressurized water-entrance opening. The channel cleaning apparatus receives in the tube or channel an advance motion based on the recoil force of the water discharged.

A channel cleaning apparatus furnished as a bottom or floor cleaning apparatus is described in the German printed petit patent document DE 93 08 910-U1, wherein the apparatus exhibits a closed and compact outer structure. The one-sided, rounded surface facilitates an automatic reerection. A flushing head with two sliding runners or skids, which are connected to each other by a roll-over bar, is described in the German printed patent document DE-OS 32 37 583-A1. The flushing head exhibits a water connector as a pressurized water-entrance opening and recoil openings as pressurized water-discharge openings in the direction of the water connector. The recoil openings are in this case disposed in superpositioned rows and are directed downwardly in the direction of the channel bottom or floor.

Furthermore, channel-cleaning nozzles in the shape of rotation-symmetrical bodies are known, which also exhibit a water connection as a pressurized water-entrance opening and therewith connected and rearwardly directed recoil openings. The pressurized water-entrance opening is in this case disposed in the center of the rotation-symmetrical body and the pressurized water-discharge openings are disposed on the same or different partial circles around the center of the rotation-symmetrical body.

Such a nozzle body made of solid material is described in the German printed petit patent document DE-G 92 14 268.8. It is a disadvantage in this solution that the water impinges onto the bore base of the water connector, whereby turbulences and swirls and thus power losses are occurring. Furthermore, it has been shown to be disadvantageous that the two connection bores meet each other at an acute angle.

A flow-technically already somewhat improved nozzle is described in the printed patent document WO 85/05295. In this construction, the connection channels between the pressurized water-entrance opening and the recoil opening exhibit a relatively large radius.

A disadvantage of all known bottom floor cleaners, flushing heads, and channel-cleaner nozzles is that during the cleaning process no observation and no determination of the soiling state or, respectively, cleaning state of the channel and no recognition of damaged areas in the channel is possible. Therefore, it is up to now necessary to perform several cleaning cycles in order to obtain assurance that the respective channel section has been sufficiently cleaned. The water use and the energy use necessary for this purpose surpasses by a multiple the amount necessary in reality. At this time, the recognition of damaged areas in the channel require a cost-intensive channel inspection.

In addition, cleaning apparatuses and manipulators for the interior of pipe lines and channels are known from the European printed patent document EP 0,560,611-A1, European printed patent document EP 0,395,628-A2, European printed patent document EP 0,560,611-A1, German printed patent document DE 3,111,814-A1, which apparatuses are furnished with camera connected by cable for monitoring the cleaning operation and manipulation work. These cleaning apparatuses and manipulators exhibit however a substantially complicated constructive structure and a completely different mode of operation. It is also a decisive disadvantage in connection with these cleaning apparatuses and manipulators that in the course of the cleaning operations there exists a high danger of damaging the transfer cables. Hydrodynamic channel-cleaning apparatuses of a simple construction of the bottom floor cleaner or of the channel-cleaning nozzles, which allow an immediate determination of the soiling state and of the cleaning state during the cleaning process, are at this time unknown. A further disadvantage of the above-described bottom floor cleaner is that its weight cannot be adapted to the respective pump power.

SUMMARY OF THE INVENTION

1. Purposes of the Invention

It is an object of the present invention to provide a channel-cleaning apparatus which exhibits a relatively simple construction, which allows a determination of the degree and state of the cleaning operations and of the degree and state of soiling of the respective channel section during the cleaning process, which channel-cleaning apparatus can be varied in its weight according to the pump power, and which assures a highest possible degree of effectiveness, and thus a maximum cleaning power while minimizing energy requirements and water use.

These and other objects and advantages of the present invention will become evident from the description which follows.

2. Brief Description of the Invention

The present invention provides

According to the invention, a monitoring unit can selectively be applied at the base body of the channel-cleaning apparatus in the construction form of a bottom floor cleaner or of a channel-cleaning nozzle. The monitoring unit comprises at least a camera module and at least an associated video emitter. The video emitter is coordinated to a video receiver, which can be connected to a monitor.

The image transmission between the video emitter and the video receiver part is performed wireless. Infrared headlights and spotlights and possibly additional headlights and spotlights are coordinated to the camera module for illuminating the channel. A battery is furnished at the base body for feeding electrical power to the camera module, to the video emitter, and to the headlights and/or spotlights.

If the channel-cleaning apparatus is constructed in the kind of a bottom floor cleaner with a base body and two roll-over bars, as well as a connector for a water hose as a pressurized water-entrance opening and pressurized water-discharge openings on the side of the water connector, then the monitoring unit is installed either on the base body or in a hollow space of the base body. In the latter case, preferably the battery, which is disposed in a coordinated battery casing, is inserted fully or in part into the hollow space. Other construction units or parts of the monitoring apparatus are disposed also in a casing above the battery casing. The casings should be sealed watertight to protect the electrical and electronic components from an interference with water.

If the cleaning process is to be performed without video monitoring, then the monitoring unit can also be removed. The hollow space, in which the battery had been installed, can then be closed with a closure cover and, as desired, be filled with a ballast material. Preferably lead granules, sand, water or a sand/water mixture is employed as a ballast material.

The monitoring device can exhibit in each case a camera module both in cleaning direction and advance direction as well as oppositely thereto. Upon application of two camera modules, a common or in each case a separate video emitter can be coordinated to the camera modules.

The monitoring device exhibits a specific printed circuit board for the wireless remote control of the switching on and switching off of the camera modules, of the video emitters, and of the headlamps and/or spotlights. The objective holder and lens carrier of the camera module is fitted into a separating wall. The container wall of the casing, which is disposed in front of the lens of the objective is made of glass or transparent plastic and is continuously cleaned with a window wiper during the cleaning process and/or is coated with a special water-repellent coating.

The battery exhibits a light-emitting diode for indicating the status of the battery. If the channel-cleaning apparatus is formed in the kind of a channel-cleaning nozzle, then the camera module is preferably disposed opposite to the hose connection. For this purpose, the base body of the channel-cleaning nozzle is formed of several parts and exhibits a hollow space for the installation of the required electronic device components as well as for the battery. In this construction, preferably only a camera module with the associated video emitter and the required technology, as described in connection with the bottom floor cleaner, is employed.

If no video monitoring is to be performed with the channel-cleaning nozzle, then, analogously as in the case of the bottom floor cleaners, the hollow space in the nozzle body is closed with a sealing closure and filled with a ballast material.

It is possible with the solution according to the invention to adapt the channel-cleaning apparatus in the form of a bottom floor cleaner or of a channel-cleaning nozzle individually to the requirements of the respective application. The channel-cleaning apparatus can be varied in its weight depending on the employed water pressure or, respectively, to the respective pump power or, also electively, be furnished with the monitoring device. In this way, an optimizing of the cleaning process is achieved, whereby a substantial water saving and energy saving becomes possible. Furthermore, it is possible based on the employment of the camera module to distinguish already during the cleaning process heavily soiled channel sections, which require a several cleaning cycles, from lesser or not at all soiled channel sections, as well as to recognize damages of the pipe system and of the channel system.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
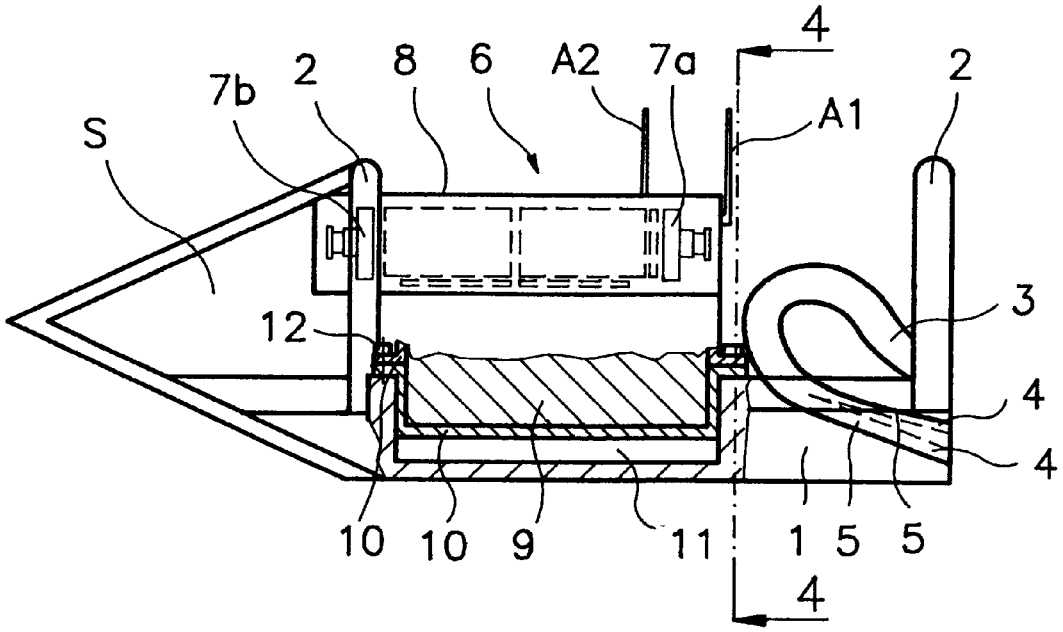
FIG. 1 is a side elevational view of the channel-cleaning apparatus in the construction of a bottom floor cleaner S with a monitoring device.

The hydrodynamic channel-cleaning apparatus according to FIG. 1 is formed in the shape of a bottom floor cleaner S and exhibits a base body 1 with two over-roll bars 2 and a connector for a water house as a pressurized water-entrance opening 3 and pressurized-water discharge openings 4 on the side of the water connector, wherein the pressurized water-entrance opening 3 is connected to the pressurized water-discharge openings 4 through water-guide conduits 5, formed as channels with circular cross-section. The longitudinal extension of the over-roll bars 2 is horizontally and perpendicular to the advance motion direction of the channel cleaning apparatus. The over-roll bars are disposed above the pressurized-water discharge openings 4. The over-roll bars 2 guard the water-guide conduits 5 against mechanical damage. A monitoring unit 6 is disposed at the base body 1. The monitoring unit 6 comprises two camera modules 7*a* and 7*b*, which camera modules 7*a* and 7*b* are disposed in a casing 8. One camera module 7*a* is directed in the direction of the pressurized water-entrance opening 3 and the second camera module 7*b* is directed in the opposite direction. A battery 9 is disposed in a battery casing 10 under the casing 8, which battery casing 10 is installed in the hollow space 11 of the base body 1. The battery casing 10 is arrested with attachment elements 12 at the base body 1.

Figure 2:
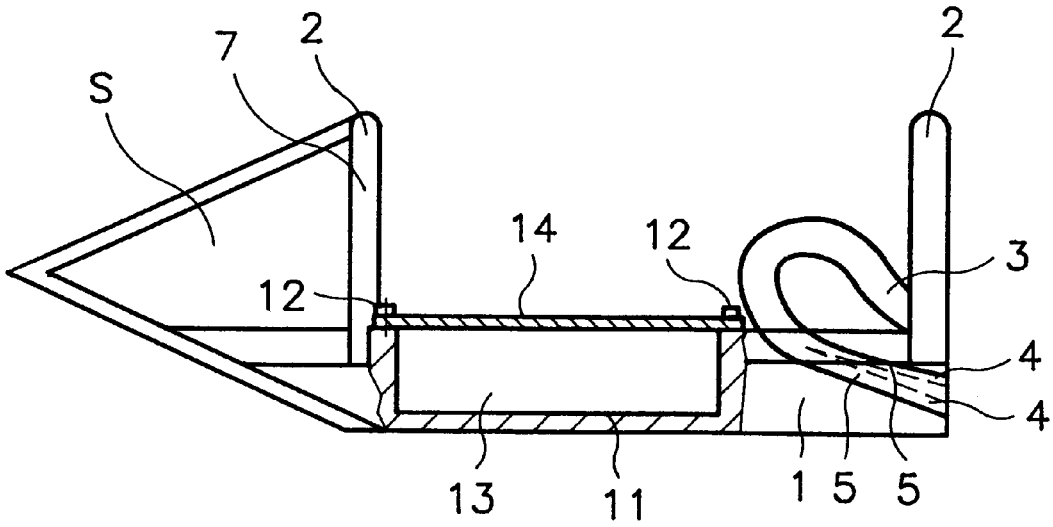
FIG. 2 is a side elevational view of the bottom floor cleaner with a cover and ballast material, disposed in a hollow space.

A bottom floor cleaner S is illustrated in FIG. 2, wherein the hollow space 10 of the bottom floor cleaner S is filled with a ballast material 13 and wherein the hollow space 10 is closed with a cover 14. The cover 14 is also attached with attachment elements 12 at the base body 1.

Figure 3:
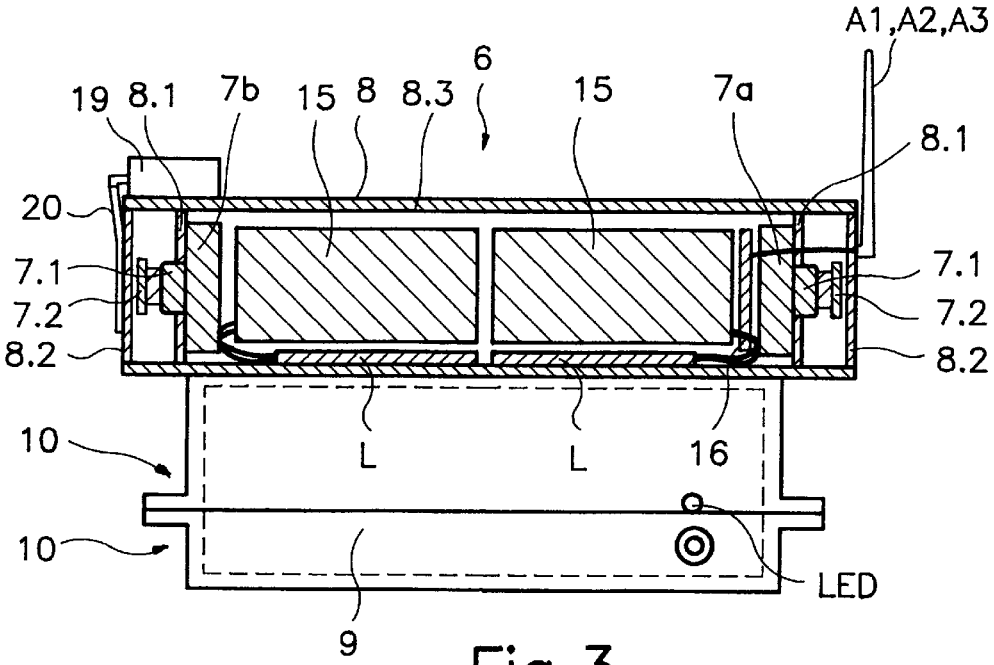
FIG. 3 is a sectional view of the monitoring device according to FIG. 1.
Figure 5:
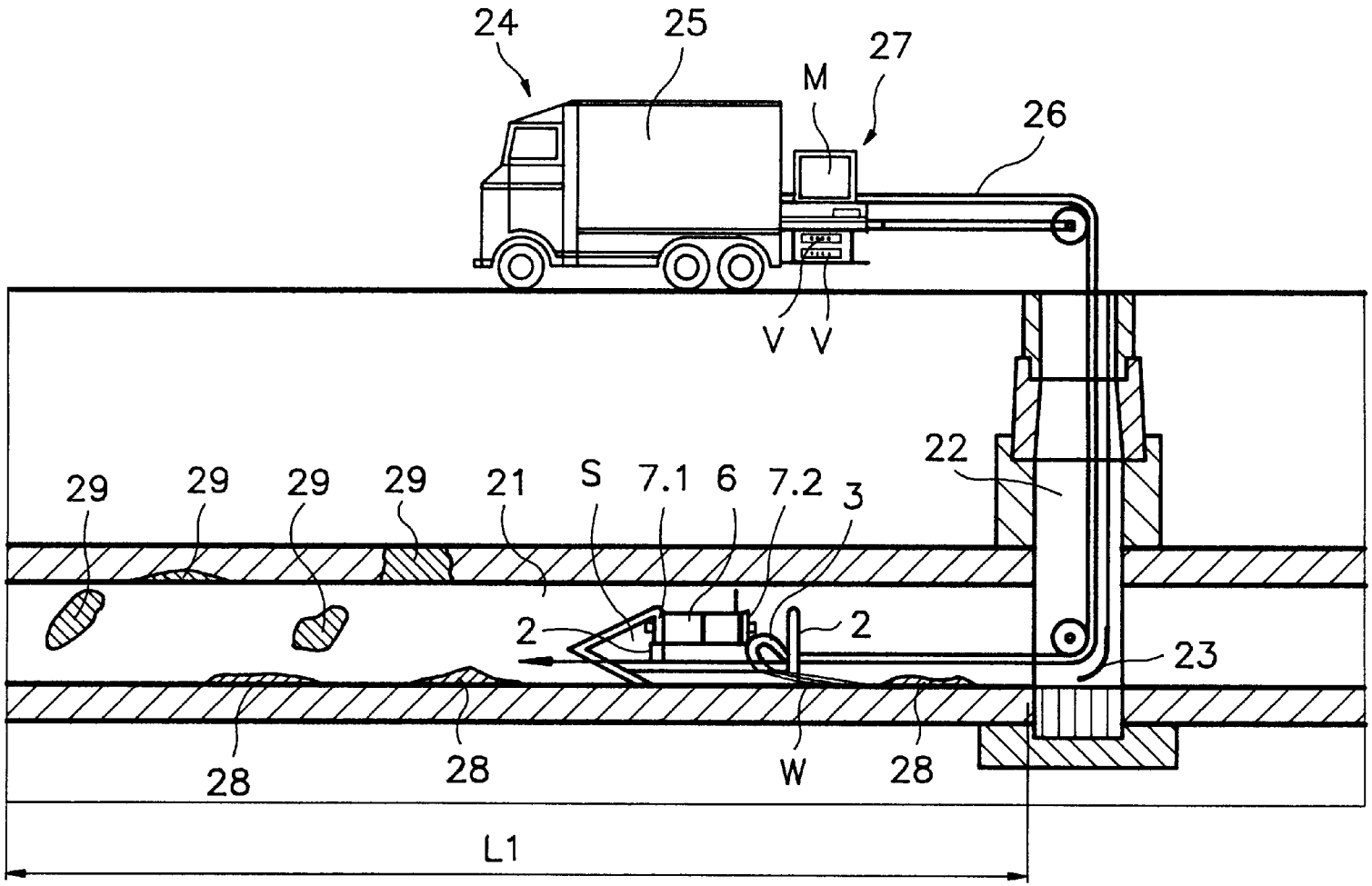
FIG. 5 shows a cleaning process and identification of damaged areas upon application of a wireless remote-controlled monitoring unit.

A sectional view of the monitoring device 6 is shown in FIG. 3. The two video emitters 15 are disposed side by side in the casing 8, and a video receiver part 16, as well as the printed circuit boards L for the video emitter 15 and the camera modules 7*a, 7b,* are disposed in the casing 8, which contains the two camera modules 7*a* and 7*b*. One camera module 7*a* is in this case directed in the direction of the pressurized-water entrance opening 3, and the second camera module 7*b* is directed in the opposite direction (FIG. 5). The lens carrying objective holders 7.1 of the camera modules 7*a* and 7*b* are in each case supported in a separating wall 8.1 of the casing 8.

The casing 8 exhibits a transparent casing wall 8.2 in front of the lenses of the objectives 7.2, wherein the casing wall 8.2 is preferably made of glass. A window wiper 20 is employed for cleaning the casing wall 8.2, wherein the window wiper 20 can for example be attached with its window wiper motor 19 on the casing cover 8.3. The window wiper 20 is also supplied with power from the battery 9. In addition to the cleaning of the casing wall 8.2 with the window wiper 20, the casing wall 8.2 can also be furnished with a commercially available special coating, which favors a pearling off or beading off of the water from the casing wall 8.2. The possibility exists to employ the window wiper or, respectively, the window wipers 20 and the coating simultaneously (FIG. 3).

Figure 7A:
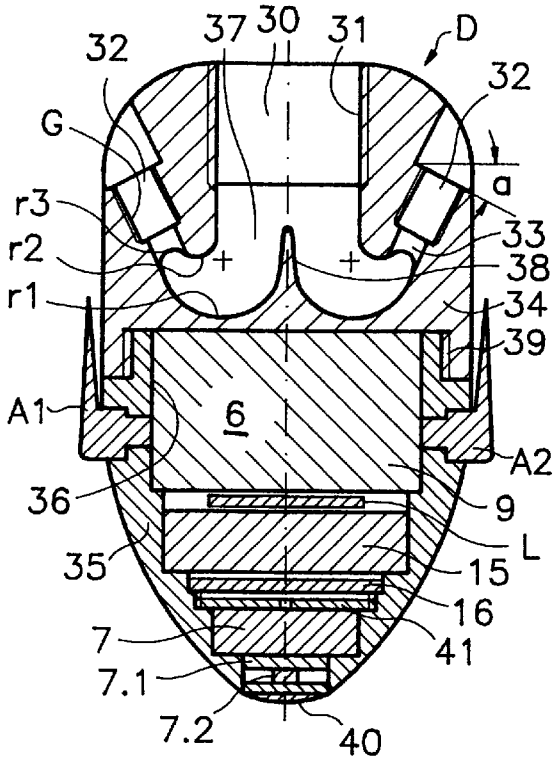
FIG. 7A is a sectional view of a channel-cleaning nozzle with a monitoring device.

A video receiver part V, connectable to a monitor M (FIG. 5), is coordinated to the video emitters 15 (FIG. 7A). The image transmission between the video emitter 15 and the video receiver part V is performed without cable and wireless. Infrared headlights and/or spotlights 17 and further headlights and/or spotlights 18 are coordinated to each camera module 7 for the illumination of the channel. The video receiver part (printed circuit board) 16 (FIG. 7A) serves for controlling the switching-on and switching-off processes of the individual components, such as camera module 7, video emitter 15, headlights and/or spotlights 17 and 18, and window wipers 20. The battery 9 for the feeding of the current is disposed in the battery casing 10 under the casing 8. The battery casing 10 is constructed in two parts and is sealed against water. The casing 8 is also sealed against water is attached either detachable or fixedly at the battery casing 10. The casing cover 8.2 is disposed preferably detachable at the side walls of the casing 8. The antennas A1, A2, and A3 for the emitter operation of the video emitters 15 to the video receiver part V and for the receiver operation of the wireless remote control FU to the associated receiver part 16 are disposed at the casing 8.

Upon employment and positioning of two camera modules 7*a* and 7*b* and two video emitters 15, both pictures can be viewed in parallel on the monitor M. It is also possible to install two camera modules 7*a* and 7*b* with only one video emitter 15 in the monitoring unit. Then, as desired, one can switch over to the respective image.

In addition to the above described embodiment with two camera modules 7*a* and 7*b* in the monitoring unit 6, there can also be employed only one camera module 7, which is then preferably directed in the direction of the pressurized water-entrance opening 3.

An economical variation is the employment of only one single camera module 7 and one video emitter 15, wherein in this case the monitoring of the cleaning process is preferably to occur in the direction of the pressurized water-entrance opening 3. In most cases, this variant of embodiment is sufficient for meeting the requirements present.

Figure 4:
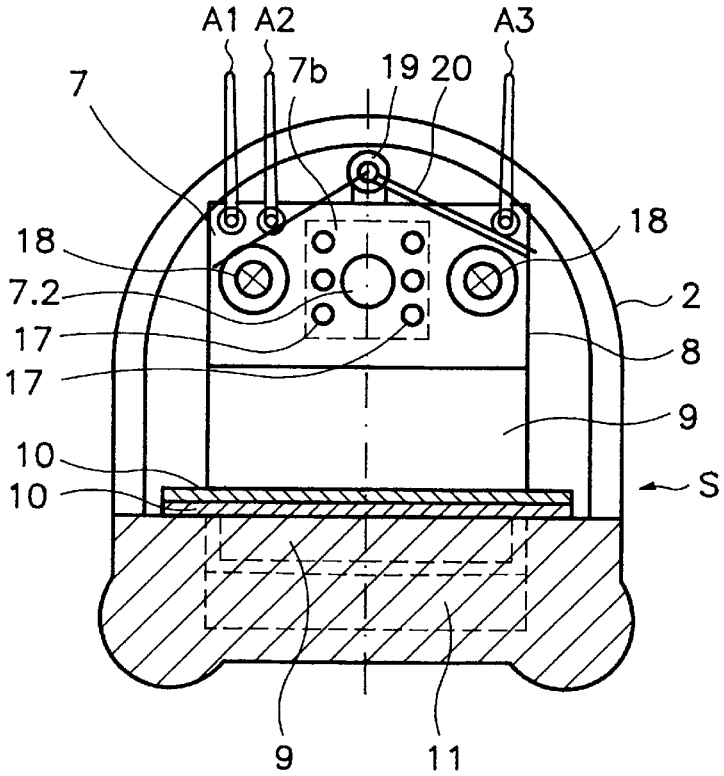
FIG. 4 is a front elevational view of the monitoring device according to FIG. 1.

The front view of the monitoring unit 6 in the direction of the camera module 7*a* is illustrated in FIG. 4. The infrared headlights and/or spotlights 17 are disposed in the region of the lenses of the objectives 7.2. Two headlights and/or spotlights 18 are disposed to the right and to the left of the lenses of the objectives 7.2.

For assuring an interference-free transmission, there is preferably employed a charge-coupled device CCD camera module 7 with an emitter-receiver installation in 5-channel technique. The emitter frequency should preferably be larger than 1 GHz. Based on the selection of a high emitter frequency, an interference-free transmission is assured even when the horizontal channel section 20 exhibits a bow or is arched or angled.

A further embodiment not illustrated of the monitoring unit 6 comprises that the video emitter or video emitters 15 and the video receiver part 16 to the wireless remote control are disposed as one unit on a printed circuit board.

Furthermore, a coupling possibility for one additional headlight and/or spotlight can be provided on the casing 8 in an advantageous way, where said additional headlight and/or spotlight can be installed on the casing 8 if the infrared headlights and/or spotlights 17 and the other headlights and/or spotlights 18 do not provide for a sufficient illumination of the channel. An additional battery can be furnished for supplying power to this headlight and/or spotlight.

The embodiment shown in FIG. 5 represents schematically the conditions during the cleaning process and the employment of a bottom floor cleaner S with a monitoring unit 6, which monitoring unit exhibits two camera modules 7*a* and 7*b*.

The channel-cleaning vehicle 24 with the water tank 25 and the pressurized-water hose 26 is disposed above the floor. The pressurized-water hose 26 is connected to the pressurized water-entrance opening 3 of a bottom floor cleaner S, which is disposed in the horizontal channel section 21 in the illustrated example. The observer stand and control stand 27 with the video receiver part(s) V (FIG. 5) and the monitor M, connected to the video receiver part(s) V, as well as the wireless remote control FU are disposed in the region of the channel cleaning vehicle 24.

A reflector mirror 23 is disposed at the bottom of the vertical channel shaft 22 according to FIG. 5, wherein the reflector mirror 23 makes the deflection of the wireless signals possible, in order to assure a reliable transmission of the wireless signals both of the video emitters 15 from the horizontal channel section 21 to the video receiver part V and of the monitor M, connected to the video receiver part V, as well as from the wireless remote control Fu in the observer stand and control stand 27 to the video receiver part 16 in the monitoring unit 6 for its control. Deposits 28 are present in the channel section 21 prior to starting the cleaning. The bottom floor cleaner S is brought into an advance motion upon application of a water pressure in an order of magnitude of 10 to 30 MPa in the direction of the arrow in the cleaning section L1. The deposits 28 and possible damaged areas 29 are in this case captured first with the camera module 7*b,* which is directed opposite to the pressurized-water entrance opening 3. Upon a return motion of the bottom floor cleaner S against the direction of the arrow, the deposits 28, disposed in front of the bottom floor cleaner S in the return motion in the cleaning section L1, are lifted and flushed away by the force of the water stream W of the pressurized water-entrance openings 4. This process is followed with the camera module 7*a* directed toward the hose connection. The speed of the return motion can be controlled dependent on and as a function of the cleaning success. If it is determined through the video surveillance in the monitor M that the respective deposit is removed, then the return speed can be increased up to a reaching of the next larger deposit 28. One proceeds in this way until all deposits 28 in the cleaning section L1 have been removed.

If the advance motion of the bottom floor cleaner 5 is prevented by possible obstacles or impedances, for example, channel ruptures and disintegrated channel walls, then the kind of obstacle or hindrance can be determined with the camera module 7*b* directed in the direction of the arrow. This facilitates substantially the determination of a decision in regard to the procedural steps for the removal of the impedance and the technology required for this purpose.

The video receiver part V can be disposed and can be connected with a corresponding cable to the monitor M in addition to the possibility, illustrated in FIG. 5, of arranging a reflector mirror 23 at the base of the channel shaft 22.

In addition to the embodiment of the channel-cleaning apparatus formed as a bottom floor cleaner S, this channel-cleaning apparatus can also be formed as a channel-cleaning nozzle. The channel-cleaning nozzle in the shape of a rotation-symmetrical base body D exhibits according to FIG. 6 a water connector 31 as a pressurized water-entrance opening 30 and therewith connected and rearwardly directed recoil openings in the form of pressurized water-discharge openings 32. The pressurized water-entrance opening 30 is disposed in this case in the center of the rotation-symmetrical base body D, and the pressurized water-discharge openings 32 are disposed on a single or on a plurality of partial and/or full circles T1, T2 or on circles having different radii around the center of the rotation-symmetrical base body D.

A thread G is furnished in the pressurized water-discharge openings 32 for screwing in reflector nozzles generating the recoil beam.

Figure 6:
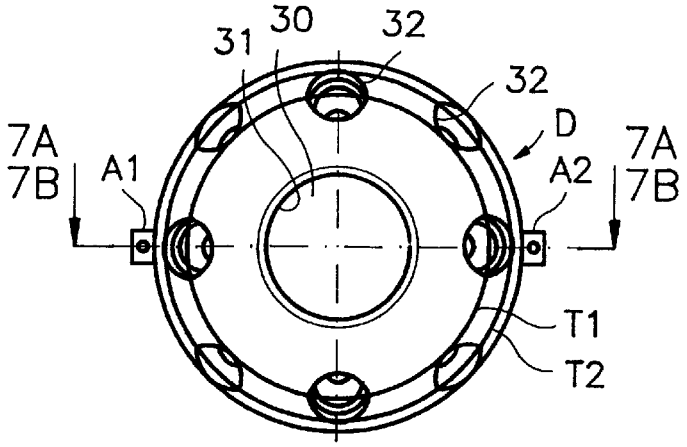
FIG. 6 is a top plan view onto a channel-cleaning nozzle.
Figure 7B:
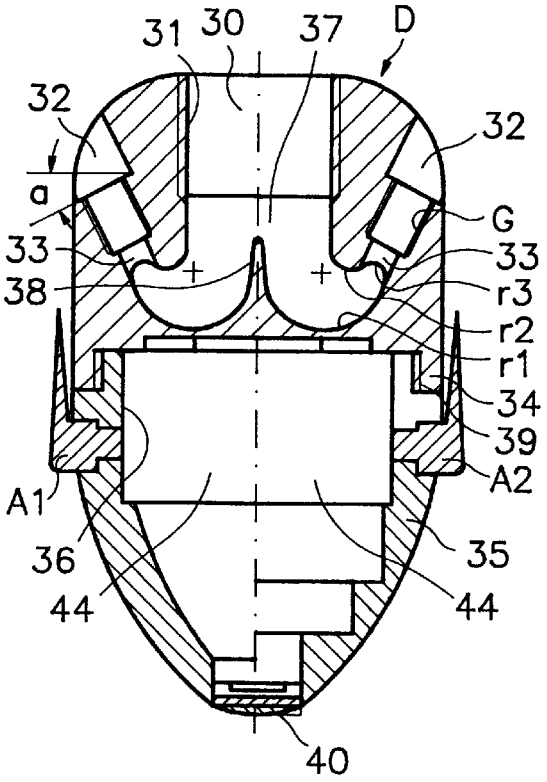
FIG. 7B is a sectional view of a channel-cleaning nozzle D with a monitoring device, wherein the monitoring device is disposed in a separate casing.

The pressurized water-entrance opening 30 is connected in this embodiment, shown in FIG. 6, through eight water-guide conduits 33 with the eight pressurized water-discharge openings 32. The sectional view of the base body D along the section line 7A, 7B–7A, 7B according to FIG. 6, is shown in FIGS. 7A, 7B. In this context, the base body D is formed of two parts. The pressurized water-entrance opening 30 and the pressurized water-discharge openings 32 are disposed in the nozzle upper part 34. A hollow space 36 is furnished in the nozzle lower part 35, wherein, as desired, the monitoring unit 6 can be installed in the hollow space 36, or wherein the hollow space 36 is filled with a ballast material 13.

The eight water-guide conduits 33 are slidingly connected and follow to the pressurized water-entrance opening 30 with the hose connector 31 in the upper nozzle part 34, where the water-guide conduits 33 form the connection to the pressurized water-discharge openings 32.

A distribution hollow space 37 is formed in connection to and following to the pressurized water-entrance opening 30. A cone-shaped water subdivider 38 is disposed at the bottom of the distribution hollow space 37, wherein the cone tip of the water subdivider 38 is directed in the direction toward the pressurized water-entrance opening 30. A first radius r1 is furnished from the base of the water subdivider 38 to the outermost point of the diameter d1 of the water-guide conduits 33. The water-guide conduits 33 are disposed with the outermost point of their diameter d1 tangentially at this first radius r1. The inclination angle in comparison to the axis X of the base body D corresponds to the angle of radiation $\alpha$. The pressurized water-entrance opening 30 expands at its end in the direction of the distribution hollow space 37 into a second radius r2, which second radius exhibits the same direction of curvature as the first radius r1 at the bottom of the distribution hollow space 37. The two radii r1 and r2 are connected to each other through a further third radius r3, which radius r3 has a direction of curvature disposed opposite to the radii of curvature r1 and r2.

The larger the angle of radiation $\alpha$ is selected, the more the part circles T1 and T2 of the pressurized water-discharge openings 32 are disposed in the direction toward the outer diameter of the base body D.

The connection between the nozzle upper part 34 and the nozzle lower part 35 is performed in this embodiment through a thread 39. For mounting, the nozzle lower part 35 is screwed into the nozzle upper part 34.

According to FIG. 7A, the monitoring unit 6 is disposed in the nozzle lower part 35. The camera module 7 is directed with the lens of the objective 7.2 of the camera module in the direction of the advance motion generated through the recoil force of the water. The objective holder 7.1 carrying the lens is in this context arrested in a corresponding recess. An protector 40 for the lens disposed in the objective is screwed into the nozzle lower part 35 in front of the objective 7.2. A separating plate 41 with a cable breakout 42 is disposed after the camera module 7 in the direction toward the pressurized water-entrance opening 30. Then, the video emitter 15, its printed circuit board L, and the video receiver part 16 are furnished. In the following, the battery 9 is installed. Furthermore, breakouts 43 for connecting the antennas A1 and A2 are disposed in the casing lower part 35. The recited arrangement of the individual electrical and electronic device elements of the monitoring unit 6 describes an embodiment and possible variant of the invention. As desired, changes in the arrangement of the individual electrical and electronic device elements are possible.

Correspondingly, there exists also the possibility to pre-install the monitoring unit 6 according to FIG. 7A in a casing 44 and, if desired, to insert the monitoring unit 6 into the hollow space 36 in the nozzle lower part 35. Suitable stops should be provided at the casing 44 and at the nozzle lower part 35 for locking. These locking elements should assure also that the connector bushings or sockets for the antennas A1 and A2 exhibit always the same position such that the antennas can be connected with a simple plug connection. The constructive embodiment of the casing 44 can be provided individually. There can be a plurality of steps of cylindrical or prismatic shape defining a hollow chamber inside the casing 44 for enclosing the various components. The structure of the casing 44 could exhibit several steps as shown in FIG. 7*b* on the right-hand side representation of this figure or the casing 44 could be adapted to the radius of the nozzle, as shown on the left-hand side representation. The hollow chamber according to the left-hand side representation partially resembles a section of a rotation symmetrical ellipsoid, paraboloid or hyperboloid.

Figure 8:
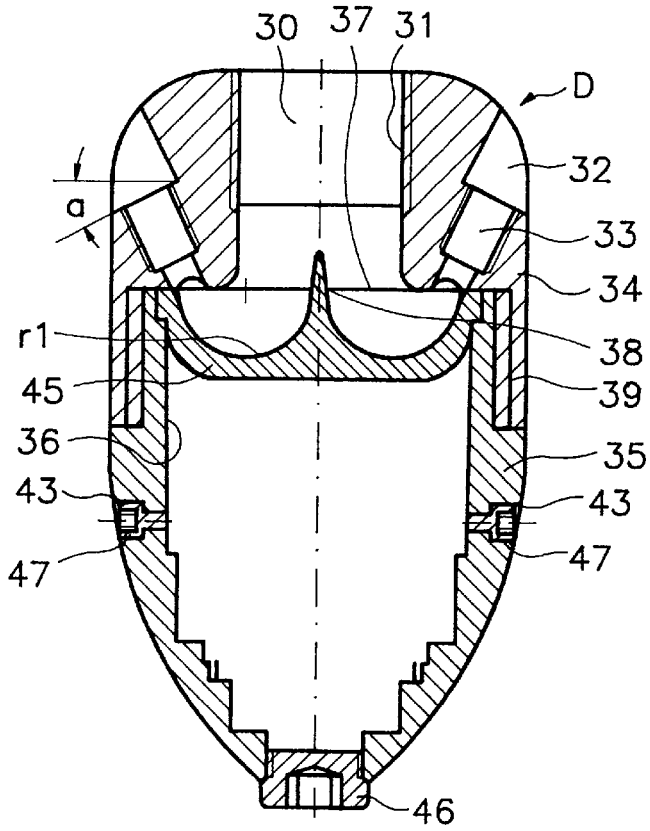
FIG. 8 is a sectional view of a channel-cleaning nozzle with ballast material.

In addition to the two-part nozzle embodiment, the base body D according to FIG. 8 can also be subdivided into three parts. In this case, the nozzle lower part 35 exhibits a form element 45, which form element 45 contains the water subdivider 38 and the first radius r1. The form element 45 is preferably made of a wear-resistant and drag-coefficient-lowering material. The form element 45 is preferably detachably inserted into the nozzle lower part 35 such that it can be exchanged upon wear.

If desired, a ballast material 13, for example in the kind of granular lead, sand, water, or sand/water mixture, can be filled into the hollow space 36 according to FIG. 8. Instead of the protector 40 for the lens in the objective, a lock screw 46 is inserted into the nozzle lower part 35 opposite to the pressurized water-entrance opening 30. Also the breakouts 43 are in each case furnished with a lock screw 47. With the application of ballast material 13 it becomes for the first time possible to vary the weight of the channel-cleaning nozzle according to the pump power.

Figure 9A:
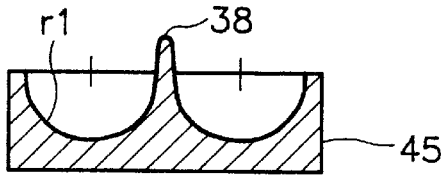
FIG. 9*a* shows a representation of the form element.
Figure 9B:
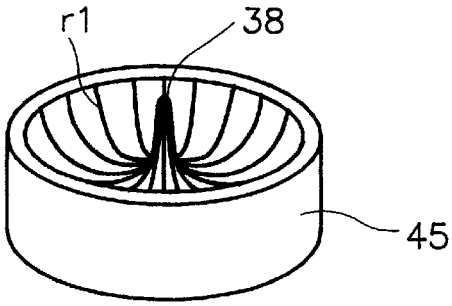
FIG. 9*b* shows a second representation of the form element.

The form element 45 is illustrated again in FIGS. 9A and 9B which contains the radius r1 and the water subdivider 38.

Only infrared headlights and/or spotlights 17 furnish an illuminating device and are coordinated to the camera module 7 according to the embodiments of FIGS. 7 and 8. The infrared headlights and/or spotlights 17 are disposed around the lens of the objective 7.2 as it is the case with the bottom floor cleaner. The arrangement of additional headlights and/or spotlights 18 and of a window wiper 20 is associated with difficulties in the case of the channel-cleaning nozzle because of space requirements. In order to allow nevertheless for the arrangement of one or several headlights and/or spotlights 18 and possibly of a window wiper, these can for example be disposed on the outside of the base body D, wherein in this case a guide basket 48 is affixed with skid-shaped protective bows, guard bows, or hoop guards 50 at the nozzle body D. The headlights and/or spotlights 18 and the window wiper or wipers 19 can also be attached directly at the guide basket 48 between the protective bows 50 according to FIG. 11 and can exhibit for example also a separate electrical power supply. The construction of the respectively most favorable embodiment for a corresponding field of application is dependent on the expert and professional skill and the workmanship of the person skilled in the art involved in the construction.

Figure 10:
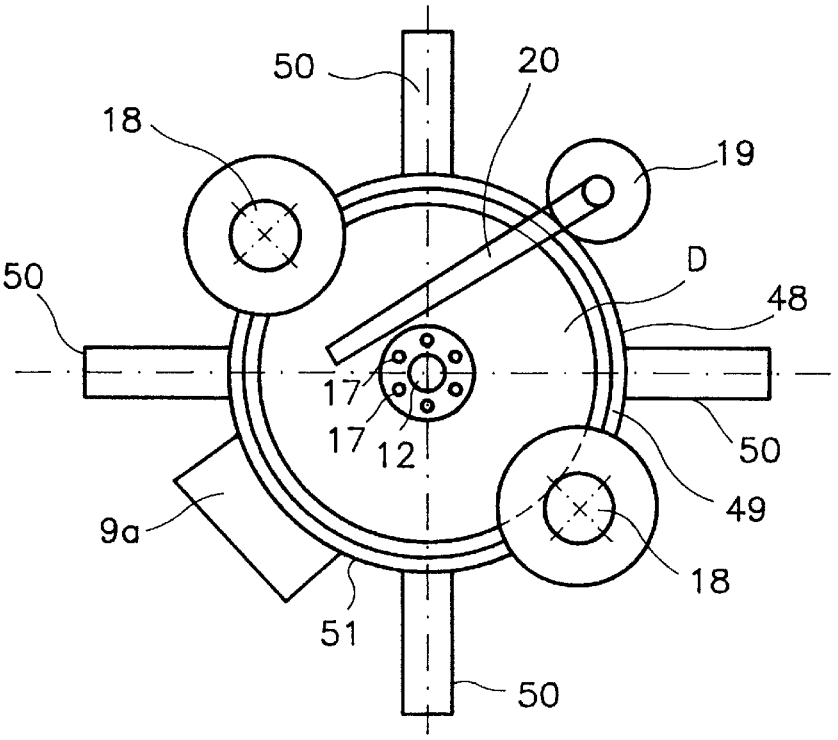
FIG. 10 shows a front elevational view of the channel cleaning nozzle with guide basket.

A variant is illustrated in FIG. 10, wherein a guide basket 48 with a clamping ring 49 is disengageably attached at the outer diameter of the base body D, wherein the clamping ring 49 is adapted to the diameter of the base body D. The guide basket 48 (FIG. 11) exhibits four skid-shaped elements 50, which are disposed in each case staggered by 900 relative to each other. The number of the skid-shaped elements 50 can be changed as desired. Two headlights and/or spotlights 18 are attached opposite to each other within these skid-shaped elements 50. Furthermore, the window wiper 20 with its window-wiper motor 19 is attached between two skids, for example at the clamping ring 49. An additional battery 9*a* for the operation of the headlights and/or spotlights 18 and of the window wiper 20 is disposed opposite to the clamping ring 49. In order to simplify the operation of the window wiper 20, a protective disk window 51 made of a transparent material is disposed at the ends of the skid-shaped elements 50 in front of the lens of the objective 7.2, which protective disk window 51 is cleaned by the window wiper 20.

Figure 11:
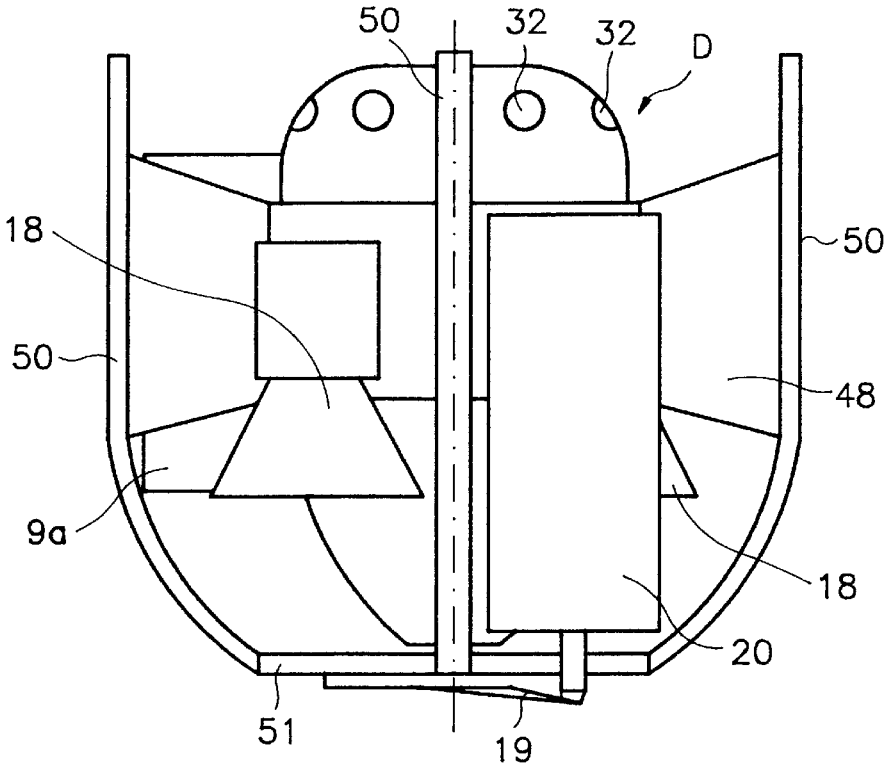
FIG. 11 shows a top planar view of the interior of the channel cleaning nozzle of FIG. 10.

FIG. 11 shows the interior of the basket 48 in a top planar view. The recessed position of the secondary headlamps 8 is recognized relative to the position of the casing of the window wiper motor 19. The shape of the skid shaped elements 50 can be seen in FIG. 11 on the left and right sides. The skid-shaped elements 50 exhibit a curved front section with a convex-shaped outer side in their front part and with a straight section in their rear part. The rear part of the skid-shaped element 50 can have a length from about 1 to 1.5 times the length of the convex-shaped outer side.

The solution according to the present invention, where for the first time a bottom floor cleaner and a channel-cleaning nozzle are connected to and are combined with a monitoring unit 6, allows the cleaning of the respective channel section with in most cases only one single cleaning cycle, where conventionally frequently ten or more cleaning cycles were necessary. The water expenditure, the energy expenditure, and the time expenditure is thereby reduced to a minimum. At the same time, a maximum cleaning success is assured based on the monitoring of the cleaning process. It is furthermore possible for the first time to identify and to localize damaged areas in the channel, for example pipe breaks, cracks, displacements, and the like during the cleaning process. It is additionally advantageous that the channel cleaning apparatuses can be employed for the channel cleaning also without monitoring devices, where the weight of the channel cleaning apparatuses can be varied with ballast material and can be adapted to the respective pump power.

It will be understood that each of the elements described above, or two or more together, may also find a useful application in other types of channel cleaning and monitoring apparatuses differing from the types described above.

While the invention has been illustrated and described as embodied in the context of a hydrodynamic apparatus for cleaning channels and for monitoring channels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydrodynamic channel-cleaning apparatus for cleaning pipes and channels including a base body;

a connector attached solidly to the base body and having a side for connecting to water with a water hose;

a pressurized water-entrance opening furnished on the side of the connector;

pressurized water-discharge openings furnished on the side of the connector;

water guide conduits disposed on the base body and connecting the pressurized water-entrance opening to the pressurized water-discharge openings through a distribution hollow space and a cone-shaped water subdivider having a cone tip directed toward the pressurized water-entrance opening and disposed at a bottom of the distribution hollow space;

a camera module disposed on the base body;

an illuminating device furnished at the base body;

a video emitter disposed at the base body and connected to the camera module;

a video receiver part connected by a wireless image transmission to the video emitter;

a monitor connected to the video receiver part;

a headlamp disposed at the base body and associated with the camera; and a battery disposed at the base body and connected to the camera module, to the video emitter, and to the headlamp for feeding electrical current to the camera module, to the video emitter, and to the headlamp.

2. The hydrodynamic channel-cleaning apparatus according to claim 1, further comprising a casing attached to the base body, wherein the camera module is disposed in the casing and is directed in advance motion direction based on the recoil force of water;

a second camera module disposed in the casing and directed in a backward direction relative to the direction of motion; and wherein the water guide conduits are formed as channels having a circular cross-section.

3. The hydrodynamic channel-cleaning apparatus according to claim 2 further comprising a second video emitter disposed at the base body and connected to the second camera module.

4. The hydrodynamic channel-cleaning apparatus according to claim 1, further comprising a control module attached to the base body and connected to the camera module, to the video emitter, to the headlamps and to the battery;

a remote control receiver connected to the control module for enabling a remotely actuated switching on and a remotely actuated switching off of the camera module, of the video emitter, and of the headlamps; and a remote control unit connected to the remote control receiver by wireless transmission.

5. The hydrodynamic channel-cleaning apparatus according to claim 1 further comprising a casing attached to the base body;

a separating wall attached to the base body; and an objective holder carrying a lens and incorporated in the camera module and fitted into the separating wall, wherein the casing includes a casing wall and wherein the casing wall is disposed in front of the lens of the objective holder and wherein the casing wall is made of a transparent material, and wherein the camera module is arranged on the base body of a bottom floor cleaner.

6. The hydrodynamic channel-cleaning apparatus according to claim 1 further comprising a casing attached to the base body;

an objective holder carrying a lens and incorporated in the camera module, wherein the casing includes a casing wall and wherein the casing wall is disposed in front of the lens of the objective holder and wherein the casing wall is made of a transparent material, and wherein the camera module is arranged on the base body of a bottom floor cleaner; and a window wiper disposed on the casing wall for cleaning the casing wall during the work performing process continuously.

7. The hydrodynamic channel-cleaning apparatus according to claim 1 further comprising a casing attached to the base body; and an objective holder carrying a lens and incorporated in the camera module, wherein the casing includes a casing wall and wherein the casing wall is disposed in front of the lens of the objective holder and wherein the casing wall is made of a transparent material, wherein the casing wall is furnished with a water-repelling coating, and wherein the camera module is arranged on the base body of a bottom floor cleaner.

8. The hydrodynamic channel-cleaning apparatus according to claim 1, further comprising an objective holder carrying a lens and incorporated in the camera module; and a transparent protector for the lens of the objective holder and disposed in front of the objective holder of the camera module, and wherein the camera module is arranged in the base body of a channel-cleaning nozzle.

9. The hydrodynamic channel-cleaning apparatus according to claim 1, further comprising an objective holder carrying a lens and incorporated in the camera module;

a transparent protector for the lens of the objective holder and disposed in front of the objective holder of the camera module, and wherein the camera module is arranged in the base body of a channel-cleaning nozzle; and a window wiper disposed on the transparent protector for cleaning the transparent protector during the work performing process continuously.

10. The hydrodynamic channel-cleaning apparatus according to claim 1, further comprising an objective holder carrying a lens and incorporated in the camera module; and a transparent protector for the lens of the objective holder and disposed in front of the objective holder of the camera module, wherein the transparent protector is furnished with a water-repelling coating, and wherein the camera module is arranged in the base body of a channel-cleaning nozzle.

11. The hydrodynamic channel-cleaning apparatus according to claim 1 further comprising a second camera module attached to the base body and directed in a backward direction relative to the direction of motion;

a second headlamp disposed at the base body and associated with the camera, wherein the first infrared headlamp is coordinated to the first camera module, wherein the second infrared headlamp is coordinated to the second camera module; and a secondary headlamp mounted on the base body.

12. The hydrodynamic channel-cleaning apparatus according to claim 1 further comprising a light-emitting diode connected to the battery, wherein the light-emitting diode indicates battery status.

13. The hydrodynamic channel-cleaning apparatus according to claim 1 further comprising a hollow chamber of the channel cleaning apparatus disposed in the base body and formed between a nozzle lower part screwed into a nozzle upper part and a form element inserted between the nozzle lower part and the nozzle upper part, wherein as desired alternatively the camera module and the battery is installed in the hollow chamber of the channel-cleaning apparatus, or a ballast material is filled in the hollow chamber of the channel cleaning apparatus.

14. The hydrodynamic channel-cleaning apparatus according to claim 13, wherein a member of the group selected from lead granules, sand, water, a sand/water mixture and mixtures thereof is employed as a ballast material.

15. The hydrodynamic channel-cleaning apparatus according to claim 1, wherein infrared headlamps (17) are coordinated to each camera module (6), and wherein further secondary headlamps (18) are provided in addition to the infrared headlamps (17);

wherein the battery (9) includes and exhibits a light-emitting diode (10) for indicating battery status;

wherein a hollow space (11, 36) is disposed in the base body (1, D), and wherein either the monitoring unit (6) with the associated battery (9) is installed in the hollow space (11, 36) of the channel-cleaning apparatus, or the hollow space (11, 36) is filled, as desired, with a ballast material (13); and wherein lead granules, sand, water, or a sand/water mixture are employed as a ballast material (13).

16. A hydrodynamic channel-cleaning apparatus for cleaning pipes and channels including a connector for a water hose as a pressurized water-entrance opening (3) and pressurized water-discharge openings (4) on a side of a water connection of a hydrodynamic channel-cleaning apparatus, wherein the pressurized water-entrance opening (3) is connected to the pressurized water-discharge openings (4) through water-guide conduits (5) in the shape of channels with circular cross-section, a distribution hollow space (37) and a cone-shaped water subdivider (38) having a cone tip directed toward the pressurized water-entrance opening (30) and disposed at a bottom of the distribution hollow space (37), and a video monitoring unit (6), which, as desired, can be disposed at or in a base body (1, D) of the channel-cleaning apparatus, and which base body includes an illuminating device, wherein an image transmission between a video emitter (15) and a video receiver part (V) is performed wireless, wherein the video monitoring unit (6) includes at least one camera module (7) and at least one associated video emitter (15), wherein one video receiver part (V), connectable to a monitor (M) is coordinated to the video emitter (15), and at least one headlamp is coordinated to the camera module (7), and wherein a battery (9) is furnished for the electrical current feed of the camera module (7), the video emitter (15), and the headlamp.

17. The hydrodynamic channel-cleaning apparatus according to claim 16, wherein a first camera module (7*a* and 7*b*) is disposed in the casing (8) and is directed in advance motion direction based on the recoil force of water and wherein a second camera module (7*a* and 7*b*) is disposed in the casing and is directed in a backward direction relative to the direction of motion.

18. The hydrodynamic channel-cleaning apparatus according to claim 16, wherein one video emitter (15) is coordinated to each camera module (7*a,* 7*b*) in case of two camera modules.

19. The hydrodynamic channel-cleaning apparatus according to claim 16, wherein the monitoring unit (6) exhibits a control module (16) actuatable by way of a wireless remote control, wherein the control module (16) renders possible a switching on and a switching off of the camera module (7), of the video emitter (15), and of the headlamps.

20. The hydrodynamic channel-cleaning apparatus according to claim 16, wherein in case the camera module (6) is arranged on a bottom floor cleaner (S), then an objective holder carrying a lens (7.1) of the camera module (7) is fitted into a separating wall (8.1) and wherein a casing wall (8.2) of the casing (8) is disposed in front of a lens of an objective and is made of glass or a transparent plastic, and wherein in case the monitoring unit (6) is arranged in the base body (D) of a channel-cleaning nozzle, then a transparent protector (40) of the lens of the objective is disposed in front of the objective holder (7.1) of the camera module (7).

21. The hydrodynamic channel-cleaning apparatus according to claim 20 wherein in case the camera module (6) is arranged on the bottom floor cleaner (S), then each transparent casing wall (8.2), disposed in front of the lens of an objective, and wherein in case the camera module (6) is arranged in the base body (D) of the channel-cleaning nozzle, then the protector (40) of the lens of the objective or a safety protector screen (51), disposed in front of the protector (40) of the lens of the objective, is cleaned continuously during the work performing process with a window wiper (20) and/or is furnished with a special water-repelling coating.

22. The hydrodynamic channel-cleaning apparatus according to claim 1, wherein the camera module is a charge-coupled device CCD with an emitter-receiver installation having an emitter frequency larger than 1 GHz.

23. A hydrodynamic channel-cleaning apparatus for cleaning pipes and channels including a base body;

a connector attached solidly to the base body having a side for connecting to water with a water hose;

a pressurized water-entrance opening furnished on the side of the connector; pressurized water-discharge openings furnished on the side of the connector;

water guide conduits disposed on the base body and connecting the pressurized water-entrance opening to the pressurized water-discharge openings through a distribution hollow space and a cone-shaped water subdivider having a cone tip directed toward the pressurized water-entrance opening and disposed at a bottom of the distribution hollow space;

a camera module disposed on the base body;

an illuminating device furnished at the base body;

a video emitter disposed at the base body and connected to the camera module;

a video receiver part connected to the video emitter;

a monitor connected to the video receiver part;

a headlamp diposed at the base body and associated with the camera;

a battery disposed at the base body and connected to the camera module, to the video emitter, and to the headlamp for feeding electrical current to the camera module, to the video emitter, and to the headlamp;

a control module attached to the base body and connected to the camera module, to the video emitter, to the headlamps and to the battery;

a remote control receiver connected to the control module for enabling a remotely actuated switching on and a remotely actuated switching off of the camera module, of the video emitter, and of the headlamps; and a remote control unit connected to the remote control receiver by wireless transmission.

* * * * *